US011447369B2

(12) United States Patent
Murphy

(10) Patent No.: US 11,447,369 B2
(45) Date of Patent: Sep. 20, 2022

(54) ELECTRICALLY HEATED ELEVATOR TENSION MEMBER

(71) Applicant: OTIS ELEVATOR COMPANY, Farmington, CT (US)

(72) Inventor: Cole Downey Murphy, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 312 days.

(21) Appl. No.: 16/872,470

(22) Filed: May 12, 2020

(65) Prior Publication Data

US 2021/0354957 A1 Nov. 18, 2021

(51) Int. Cl.

| | |
|---|---|
| ***B66B 7/12*** | (2006.01) |
| ***B66B 5/00*** | (2006.01) |
| ***B66B 5/02*** | (2006.01) |
| ***B66B 7/06*** | (2006.01) |

(52) U.S. Cl.

CPC ..... *B66B 7/12* (2013.01); *B66B 5/0018* (2013.01); *B66B 5/02* (2013.01); *B66B 7/062* (2013.01)

(58) Field of Classification Search

CPC ..... B66B 7/062; B66B 7/1215; B66B 7/12; B66B 7/06; B66B 5/0018; B66B 5/02; H05B 3/34; H05B 3/36

See application file for complete search history.

(56) References Cited

U.S. PATENT DOCUMENTS

| | | | | |
|---|---|---|---|---|
| 9,862,571 | B2 * | 1/2018 | Sun | G01R 17/00 |
| 9,994,423 | B2 * | 6/2018 | Guilani | B29D 29/06 |
| 10,029,888 | B2 * | 7/2018 | Lehtinen | H01R 13/207 |
| 2002/0194935 | A1 * | 12/2002 | Clarke | B66B 7/1223 73/862.391 |
| 2011/0148442 | A1 * | 6/2011 | Berner | B66B 7/1223 324/691 |
| 2013/0162266 | A1 * | 6/2013 | Fargo | B66B 7/1223 324/705 |
| 2016/0002006 | A1 * | 1/2016 | Sun | G01R 17/00 187/254 |
| 2021/0139279 | A1 * | 5/2021 | Guilani | B29D 29/00 |
| 2021/0309179 | A1 * | 10/2021 | Zhang | D03D 1/0005 |
| 2021/0354957 | A1 * | 11/2021 | Murphy | B66B 7/062 |

* cited by examiner

*Primary Examiner* — Michael A Riegelman

(74) *Attorney, Agent, or Firm* — Carlson, Gaskey & Olds, P.C.

(57) ABSTRACT

An illustrative example embodiment of a method provides control over a temperature of a jacket on an elevator tension member that includes at least one electrically conductive cord that is at least partially covered by the jacket. The method includes determining an amount of electrical energy needed to achieve a desired temperature of the jacket and supplying the determined amount of electrical energy to the electrically conductive cord.

20 Claims, 2 Drawing Sheets

ELECTRICALLY HEATED ELEVATOR TENSION MEMBER

BACKGROUND

Some elevator systems are traction-based and include a car and counterweight suspended by roping that typically includes several tension members. Traditional roping included steel cables referred to as round steel ropes as the tension members. More recently, other configurations of tension members have been used in place of round steel ropes. For example, a coated steel belt includes a plurality of load bearing cords encased in a jacket made of a compressive material, such as polyurethane.

The advances in elevator roping technology may provide weight and material cost savings compared to larger round steel ropes. Additionally, it has become possible to use smaller machine motors and smaller sheaves for propelling the elevator car.

One shortcoming of coated elevator tension members is that the jacket material may become less durable under certain conditions. For example, cold temperatures in a hoistway contribute to accelerated degradation of the jacket. The compressible jacket material may be relatively stiff when it is cold. Higher bending stresses as the jacket wraps around the sheaves of the elevator system increase the likelihood that cracks may begin to form in the jacket material. Cracks and other types of degradation of the jacket material increases the need for maintenance or replacement.

SUMMARY

An illustrative example embodiment of a method provides control over a temperature of a jacket on an elevator tension member that includes at least one electrically conductive cord that is at least partially covered by the jacket. The method includes determining an amount of electrical energy needed to achieve a desired temperature of the jacket and supplying the determined amount of electrical energy to the electrically conductive cord.

In an example embodiment having at least one feature of the method of the previous paragraph, determining the amount of electrical energy comprises determining a temperature of at least a selected portion of the jacket, determining a difference between the determined temperature and the desired temperature of the jacket, and determining the amount of electrical energy needed to increase the determined temperature to the desired temperature.

In an example embodiment having at least one feature of the method of any of the previous paragraphs, determining the amount of electrical energy needed to increase the determined temperature to the desired temperature comprises using a relationship between electrical energy and a resistance of the at least one electrically conductive cord to select the amount of electrical energy.

In an example embodiment having at least one feature of the method of any of the previous paragraphs, determining the amount of electrical energy comprises determining a present time, identifying an amount of electrical energy associated with the present time from a predetermined schedule including times and associated amounts of electrical energy, and using the identified amount of electrical energy as the determined amount of electrical energy.

In an example embodiment having at least one feature of the method of any of the previous paragraphs, the predetermined schedule includes different amounts of electrical energy for different times of day or different amounts of electrical energy for different seasons.

In an example embodiment having at least one feature of the method of any of the previous paragraphs, determining the amount of electrical energy comprises determining an ambient temperature near at least a selected portion of the jacket and determining the amount of electrical energy from a predetermined relationship between ambient temperature and electrical energy needed to achieve the desired jacket temperature.

An example embodiment having at least one feature of the method of any of the previous paragraphs includes monitoring the temperature of the jacket and continuing the supplying if the temperature of the jacket is below the desired temperature, or pausing the supplying if the temperature of the jacket exceeds the desired temperature.

An example embodiment having at least one feature of the method of any of the previous paragraphs includes monitoring a temperature of the at least one electrically conductive cord and continuing the supplying if the temperature of the at least one electrically conductive cord is below a temperature corresponding to the jacket reaching the desired temperature, or pausing the supplying if the temperature of the at least one electrically conductive cord exceeds the temperature corresponding to the jacket reaching the desired temperature.

In an example embodiment having at least one feature of the method of any of the previous paragraphs, the at least one electrically conductive cord comprises a plurality of load bearing cords, the method comprises electrically coupling at least two of the load bearing cords, and the supplying includes supplying the electrical energy to the electrically coupled load bearing cords.

In an example embodiment having at least one feature of the method of any of the previous paragraphs, the tension member comprises a flat belt, the flat belt has at least one surface configured to engage a sheave, the at least one surface extends across a width of the flat belt between edges along sides of the flat belt, and only selected ones of the load bearing cords that are near the edges are coupled together.

An illustrative example embodiment of a device for controlling a temperature of a jacket on an elevator tension member includes at least one electrically conductive cord that is at least partially covered by the jacket, the device comprising a controller including a processor and memory associated with the processor. The controller is configured to determine an amount of electrical energy needed to achieve a desired temperature of the jacket and supply the determined amount of electrical energy to the at least one electrically conductive cord.

In an example embodiment having at least one feature of the device of the previous paragraph, the controller is configured to determine the amount of electrical energy by determining a temperature of at least a selected portion of the jacket, determining a difference between the determined temperature and the desired temperature of the jacket, and determining the amount of electrical energy needed to increase the determined temperature to the desired temperature.

In an example embodiment having at least one feature of the device of any of the previous paragraphs, the controller is configured to determine the amount of electrical energy needed to increase the determined temperature to the desired temperature using a relationship between electrical energy and a resistance of the at least one electrically conductive cord to select the amount of electrical energy.

In an example embodiment having at least one feature of the device of any of the previous paragraphs, the controller is configured to determine the amount of electrical energy by determining a present time, identifying an amount of electrical energy associated with the present time from a predetermined schedule including times and associated amounts of electrical energy, and using the identified amount of electrical energy as the determined amount of electrical energy.

In an example embodiment having at least one feature of the device of any of the previous paragraphs, the predetermined schedule includes different amounts of electrical energy for different times of day and different amounts of electrical energy for different seasons.

In an example embodiment having at least one feature of the device of any of the previous paragraphs, the controller is configured to determine the amount of electrical energy by determining an ambient temperature near at least a selected portion of the jacket and determining the amount of electrical energy from a predetermined relationship between ambient temperature and electrical energy needed to achieve the desired jacket temperature.

In an example embodiment having at least one feature of the device of any of the previous paragraphs, the controller is configured to monitor the temperature of the jacket and continue the supplying if the temperature of the jacket is below the desired temperature, or pause the supplying if the temperature of the jacket exceeds the desired temperature.

In an example embodiment having at least one feature of the device of any of the previous paragraphs, the controller is configured to monitor a temperature of the at least one electrically conductive cord and continue the supplying if the temperature of the at least one electrically conductive cord is below a temperature corresponding to the jacket reaching the desired temperature, or pause the supplying if the temperature of the at least one electrically conductive cord exceeds the temperature corresponding to the jacket reaching the desired temperature.

An illustrative example embodiment of an elevator system includes the device of any of the previous paragraphs, an elevator car, a counterweight, the elevator tension member coupling the elevator car and the counterweight, and at least one electrical connector establishing a connection between the at least one tension member and the controller. The at least one electrically conductive cord comprises a plurality of load bearing cords, at least two of the load bearing cords are electrically coupled together, and the controller is configured to supply the electrical energy to the load bearing cords that are electrically coupled together.

An example embodiment having at least one feature of the elevator system of the previous paragraph includes at least one sheave that guides movement of the tension member. The tension member comprises a flat belt, the flat belt has at least one surface configured to engage the at least one sheave, the at least one surface extends across a width of the flat belt between edges along sides of the flat belt, and the electrically coupled load bearing cords include only selected ones of the load bearing cords that are near the edges.

The various features and advantages of at least one example embodiment will become apparent to those skilled in the art from the following detailed description. The drawings that accompany the detailed description can be briefly described as follows.

DETAILED DESCRIPTION

Embodiments of a device or method consistent with the teachings of this description provide control over the temperature of a coating or jacket on an elevator tension member. Electrically conductive cords of the tension member conduct electrical current and introduce heat into the jacket material to increase the temperature of the jacket material when needed to maintain a desired jacket temperature.

Figure 1:
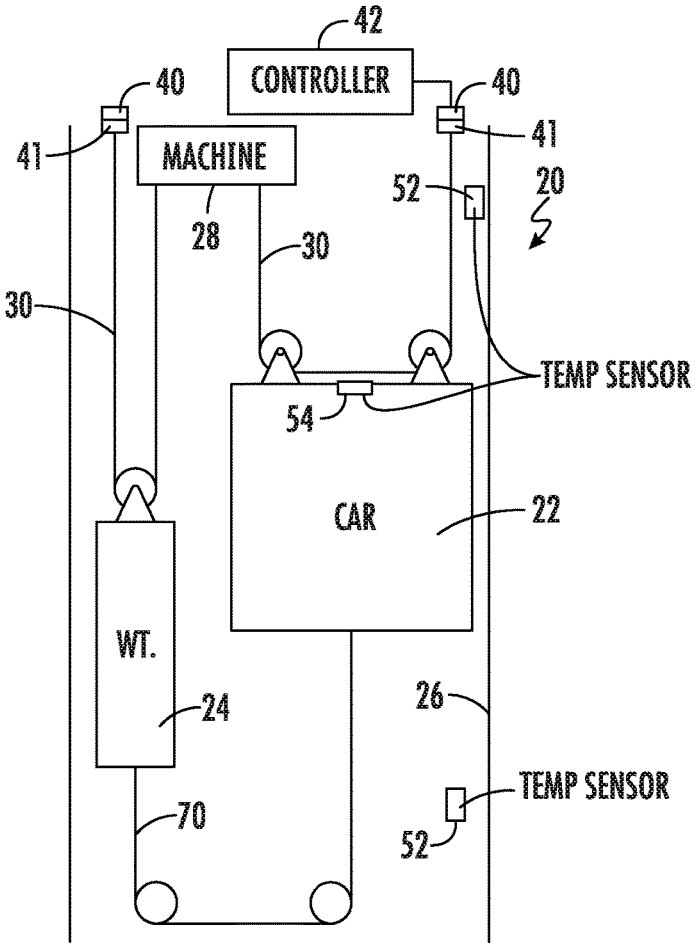
FIG. 1 schematically illustrates selected portions of an elevator system including a device for controlling a temperature of the jacket on the elevator tension member.

FIG. 1 schematically shows an elevator system 20 that includes a car 22 and counterweight 24 within a hoistway 26. A machine 28, which includes a motor, brake and traction sheave (not specifically illustrated) selectively causes movement of elevator roping that includes a plurality of tension members 30 which results in the desired movement of the car 22 and corresponding movement of the counterweight 24.

Figure 2:
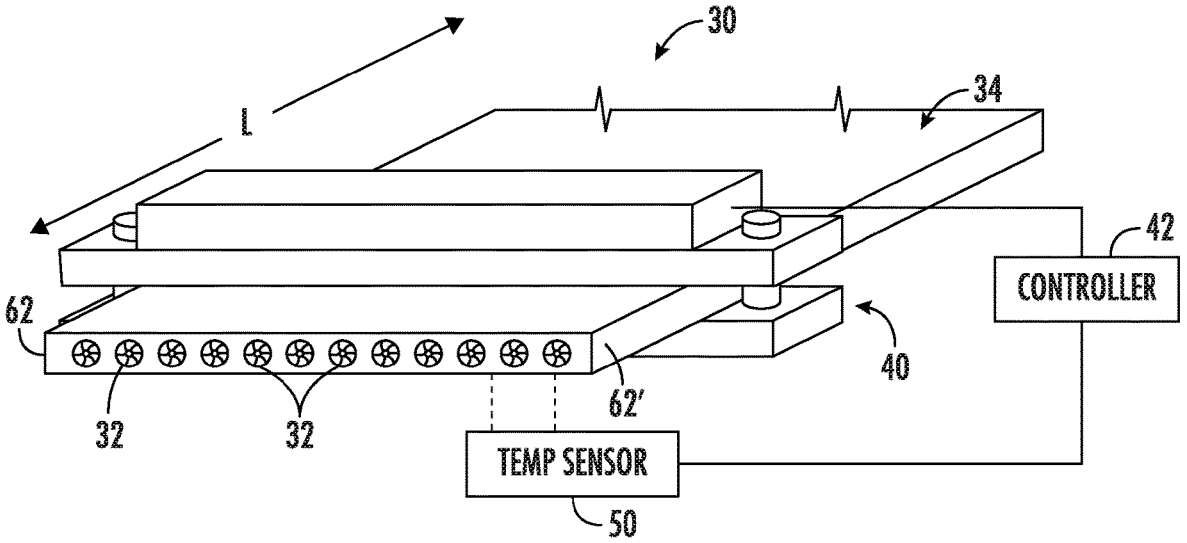
FIG. 2 is a perspective illustration of a portion of an example elevator tension member including an electrical connector and a device for controlling a temperature of the jacket of the example tension member.

As shown in FIG. 2, an example elevator tension member 30 is a coated steel belt having a plurality of load bearing cords 32 at least partially covered or encased in a jacket 34 made of a compressible material. In some embodiments, the jacket 34 is made of polyurethane and the load bearing cords 32 are metal. As can be appreciated from the drawing, the load bearing cords 32 each comprise a plurality of strands or wires, which are wound together. The material of the jacket 34 generally surrounds each of the load bearing cords 32 and fills spaces between them.

The load bearing cords 32 extend longitudinally (as shown by L in FIG. 2) in parallel along the length of the belt-shaped tension member 30. The example embodiment shown in FIG. 2 is provided for discussion purposes. Other configurations of an elevator tension member 30 are included in other embodiments.

In an example embodiment, the load bearing cords 32 are made of steel. Metallic load bearing cords 32 are electrically conductive. FIG. 2 also shows a connector 40 for establishing an electrically conductive connection with at least one of the load bearing cords 32. Although not specifically illustrated, in one example, the connector 40 includes projections that pierce through the material of the jacket 34 to establish an electrically conductive connection with at least selected ones of the load bearing cords 32.

The connector 40 may be situated near an end of the tension member 30 that remains relatively stationary during elevator system operation. For example, the elevator system 20 shown in FIG. 1 includes terminations 41 that are supported in a fixed position relative to the hoistway 26. In this example, a connector 40 is situated near each of the terminations 41 for establishing electrically conductive connections with and between at least some of the load bearing cords 32.

The connectors 40 provide an electrical interface for coupling the load bearing cords 32 with a controller 42 that includes a processor and associated memory. The processor is suitably programmed or otherwise configured to control a temperature of the jacket 34 by selectively supplying electrical energy to at least one electrically conductive cord in the jacket 34. Conducting electric current, for example, produces heat that is provided to the jacket 34 as the heat emanates from the conductive cord. In the illustrated example embodiment, at least one of the load bearing cords 32 serves as an electrical conductor that provides heat to the jacket 34.

The controller 42 is configured to determine when the jacket 34 should be heated or warmed so the material of the jacket 34 will be at a desired temperature that corresponds to a desired flexibility of the jacket 34. The controller 42 is configured to determine an amount of electrical energy needed to achieve the desired temperature of the jacket 34 and to supply that amount of electrical energy to at least one of the load bearing cords 32.

One way in which the controller 42 determines the amount of electrical energy needed to achieve a desired temperature of the jacket is based upon the temperature of at least a selected portion of the jacket 34. For example, as shown in FIG. 2, the illustrated embodiment includes a temperature sensor 50 associated with the tension member 30. The temperature sensor 50 in this example is capable of detecting a temperature of at least one of the load bearing cords 32 and a temperature of the jacket 34. The controller 42 utilizes the measured temperature of at least a portion of the jacket 34 and determines a difference between that temperature and the desired temperature of the jacket 34. Based upon that temperature difference, the controller 42 determines the amount of electrical energy needed to increase the determined temperature of the jacket 34 to the desired temperature. As electrical energy, such as electrical current, is supplied to at least one of the load bearing cords 32, the temperature of the metal or other electrically conductive material of the load bearing cords 32 increases, providing heat to the jacket 34.

In some embodiments, the memory of the controller 42 includes information regarding a relationship between electrical energy and a heating effect of the load bearing cords 32. The controller 42 utilizes that relationship to select the amount of electrical energy needed to increase the temperature of the jacket 34 to the desired temperature. That relationship can be predetermined, for example, based on known characteristics of the load bearing cords 32 including an electrical resistance of the cords and a thermal conductivity of the jacket material.

As shown in FIG. 1, temperature sensors 52 are situated in various locations within the hoistway 26. The temperature sensors 52 provide an indication of ambient temperature conditions within the hoistway 26 to the controller 42. In such embodiments, the controller 42 is configured to determine the ambient temperature near a portion of the jacket 34 situated near the temperature sensor 52. In this example, a temperature sensor 54 is situated on the elevator car 22 to provide information regarding the ambient temperature or the temperature of the portion of the tension member 30 at that location.

If the ambient temperature conditions are sufficiently low, the temperature of the jacket 34 will be below a desired temperature that ensures an appropriate amount of flexibility of the material of the jacket 34. Under such conditions, the controller 42 is configured to determine the amount of electrical energy needed to heat up the jacket 34 based upon a predetermined relationship between ambient temperatures and the amount of electrical energy needed to achieve the desired jacket temperature for the existing ambient temperature. For example, lower temperatures within the hoistway 26 will typically require larger amounts of electrical energy to generate more heat within the tension member 30 so that the jacket 34 reaches and stays at the desired temperature.

In some embodiments, the controller 42 is configured to monitor a temperature of at least one of the electrically conductive load bearing cords 32 based upon an indication from the temperature sensor 50 of FIG. 2, for example. Whenever the temperature of the monitored load bearing cord 32 is below a temperature necessary for the jacket 34 to be at the desired jacket temperature, the controller 42 supplies electrical energy to the load bearing cord 32 to heat the material of the jacket 34 until it reaches the desired temperature.

In some embodiments, the controller 42 is configured to use the electrical resistance of the conductive cord as a basis for determining the temperature of the cord or the jacket 34. A relationship between the resistance and temperature may be predetermined and stored in the memory associated with the processor as a look up table, for example, that the controller 42 uses to determine the amount of electrical energy needed to achieve the desired jacket temperature.

If the temperature of the jacket 34 exceeds the desired temperature, the controller 42 pauses or turns off the supply of electrical energy to the load bearing cord(s) 32 to avoid overheating the jacket 34. Some embodiments include a limitation or cap on the maximum current or voltage of the electrical energy supplied to the load bearing cords 32 so that the load bearing cords 32 will not reach a temperature sufficient to overheat the material of the jacket 34 even if the electrical energy is supplied over a long period of time and the jacket 34 is already at the desired temperature.

Some embodiments include monitoring the temperature of jacket 34 over time and continuing to supply electrical energy to at least one electrically conductive cord whenever the temperature of the jacket is below the desired temperature. Once the jacket reaches or exceeds the desired temperature, the electrical energy may be paused or turned off until the temperature of the jacket 34 falls below the desired temperature.

Another example embodiment includes a schedule-based control over supplying electrical energy to the load bearing cord(s) 32 for purposes of maintaining a desired temperature of the jacket 34. An example schedule used by the controller 42 includes different amounts of electrical energy for different times of day or for different seasons. By determining the present time, the controller 42 is able to use information regarding a predetermined schedule for purposes of controlling the amount of electrical energy, if any, supplied to the load bearing cords 32.

For example, nighttime temperatures in the hoistway 26 may be lower than daytime temperatures and the controller 42 is configured to determine the time of day for purposes of determining whether to supply electrical energy to a load bearing cord 32 for purposes of warming up the jacket 34. Some schedules are based on a calendar or season. For example, during winter months, the controller 42 supplies electrical energy to at least one load bearing cord 32 for purposes of maintaining the desired temperature of the jacket 34. During warmer summer months, it may not be necessary to perform any heating of the jacket 34 and the controller 42 is configured in some such embodiments to turn off or disconnect the electrical energy from the load bearing cords 32.

Figure 3:
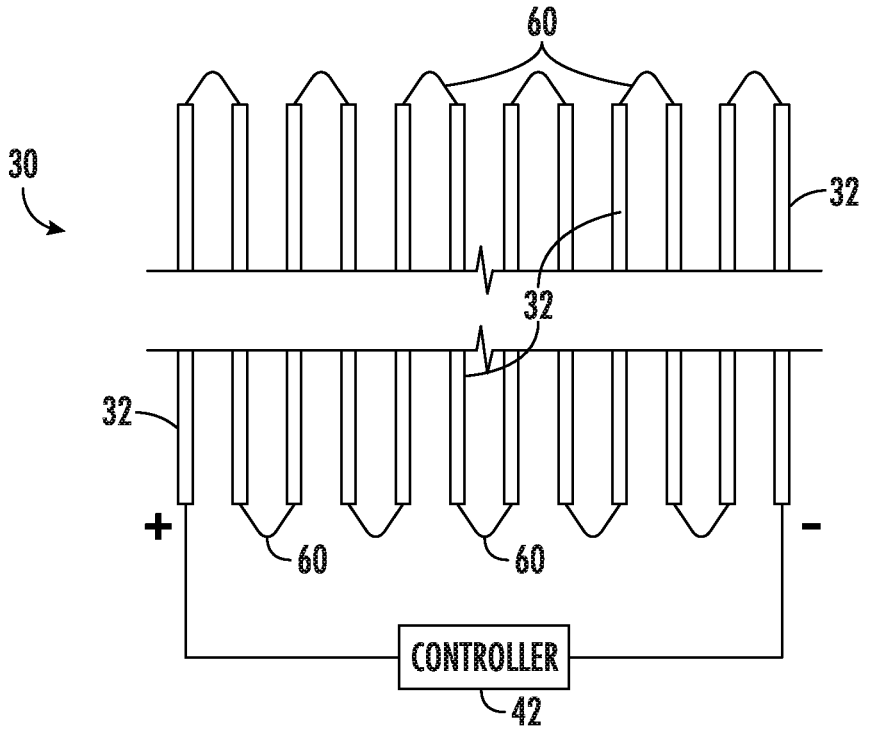
FIG. 3 schematically illustrates an example circuit configuration designed according to one embodiment.

FIG. 3 schematically illustrates an example arrangement of establishing an electrically conductive circuit using the load bearing cords 32. The connectors 40 establish electrically conductive connections 60 between adjacent load bearing cords 32 within the jacket 34. In the arrangement shown in FIG. 3, all of the load bearing cords 32 are part of the electrical heating circuit used for maintaining a desired temperature of the jacket 34. The load bearing cords 32 in FIG. 4 effectively become a series of resistors that generate heat when current is conducted along the load bearing cords 32.

The geometry of the example jacket 34 shown in FIG. 2 includes two sheave-engaging surfaces (the top and bottom in the illustration) and two lateral outer sides 62. In such embodiments, the portions of the jacket 34 near and including the lateral outer sides 62 of the jacket 34 tend to be subjected to increased bending stresses compared to a central portion of the jacket 34. Increased bending stress tends to increase the likelihood of jacket degradation at cooler temperatures.

Figure 4:
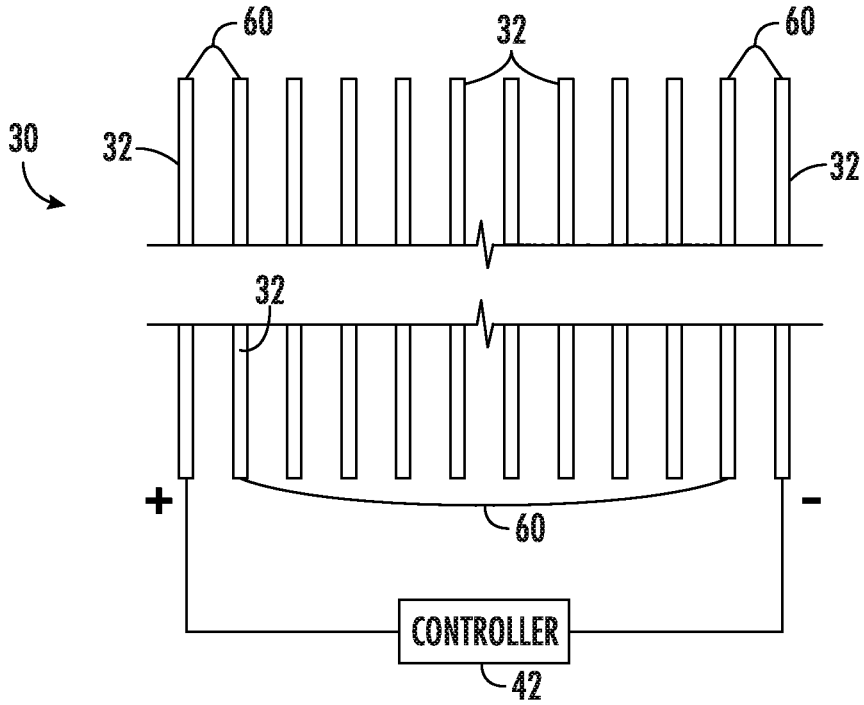
FIG. 4 schematically illustrates another circuit configuration.

The embodiment of FIG. 4 includes a circuit arrangement of load bearing cords 32 to concentrate supplied heat in the portions of the jacket 34 near the sides 62 without directly adding additional heat in the central portion of the tension member 30. As shown in FIG. 4, only the outermost load bearing cords 32 are electrically connected to each other by the connections 60 established through the connectors 40. In this example embodiment, only the selected ones of the load bearing cords 32 near the sides 62 carry electrical energy for purposes of heating the jacket 34. Prioritizing heating the lateral outer sides 62 ensures that heat is provided where it is most needed and can reduce the amount of electricity needed to adequately protect the jacket 34 against premature cracking or degradation that otherwise would occur due to environmental conditions.

The tension member 30 discussed above is used for suspending the elevator car 22 and counterweight 24. The example elevator system shown in FIG. 1 includes another tension member 70 that is suspended beneath the elevator car 22 and 24. The tension member 70 is used as a compensation rope. In some embodiments, the material of the jacket of the compensation tension member 70 will also be heated to a desired temperature using any of the arrangements and techniques described above.

In the illustrated example embodiment, at least one of the load bearing cords 32 carries electrical current to provide heat to the jacket 34. Using the load bearing cords 32 takes advantage of the electrical conductivity of those cords but embodiments consistent with this description do not necessarily require supplying electrical energy to the load bearing cords 32. In other embodiments, at least one electrically conductive cord situated at least partially within the jacket 34 that does not bear any of the load of the elevator system 20 conducts electrical current and serves as a heating element within the jacket 34.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

I claim:

1. A method of controlling a temperature of a jacket on an elevator tension member that includes at least one electrically conductive cord that is at least partially covered by the jacket, the method comprising:

determining an amount of electrical energy needed to achieve a desired temperature of the jacket; and supplying the determined amount of electrical energy to the at least one electrically conductive cord.

2. The method of claim 1, wherein determining the amount of electrical energy comprises determining a temperature of at least a selected portion of the jacket;

determining a difference between the determined temperature and the desired temperature of the jacket; and determining the amount of electrical energy needed to increase the determined temperature to the desired temperature.

3. The method of claim 2, wherein determining the amount of electrical energy needed to increase the determined temperature to the desired temperature comprises using a relationship between electrical energy and a resistance of the at least one electrically conductive cord to select the amount of electrical energy.

4. The method of claim 1, wherein determining the amount of electrical energy comprises determining a present time;

identifying an amount of electrical energy associated with the present time from a predetermined schedule including times and associated amounts of electrical energy; and using the identified amount of electrical energy as the determined amount of electrical energy.

5. The method of claim 4, wherein the predetermined schedule includes different amounts of electrical energy for different times of day or different amounts of electrical energy for different seasons.

6. The method of claim 1, wherein determining the amount of electrical energy comprises determining an ambient temperature near at least a selected portion of the jacket; and determining the amount of electrical energy from a predetermined relationship between ambient temperature and electrical energy needed to achieve the desired jacket temperature.

7. The method of claim 1, comprising monitoring the temperature of the jacket; and continuing the supplying if the temperature of the jacket is below the desired temperature, or pausing the supplying if the temperature of the jacket exceeds the desired temperature.

8. The method of claim 1, comprising monitoring a temperature of the at least one electrically conductive cord; and continuing the supplying if the temperature of the at least one electrically conductive cord is below a temperature corresponding to the jacket reaching the desired temperature, or pausing the supplying if the temperature of the at least one electrically conductive cord exceeds the temperature corresponding to the jacket reaching the desired temperature.

9. The method of claim 1, wherein the at least one electrically conductive cord comprises a plurality of load bearing cords, the method comprises electrically coupling at least two of the load bearing cords, and the supplying includes supplying the electrical energy to the electrically coupled load bearing cords.

10. The method of claim 9, wherein the tension member comprises a flat belt, the flat belt has at least one surface configured to engage a sheave, the at least one surface extends across a width of the flat belt between edges along sides of the flat belt, and only selected ones of the load bearing cords that are near the edges are coupled together.

11. A device for controlling a temperature of a jacket on an elevator tension member that includes at least one electrically conductive cord that is at least partially covered by the jacket, the device comprising a controller including a processor and memory associated with the processor, the controller being configured to:

determine an amount of electrical energy needed to achieve a desired temperature of the jacket; and supply the determined amount of electrical energy to the at least one electrically conductive cord.

12. The device of claim 11, wherein the controller is configured to determine the amount of electrical energy by determining a temperature of at least a selected portion of the jacket;

determining a difference between the determined temperature and the desired temperature of the jacket; and determining the amount of electrical energy needed to increase the determined temperature to the desired temperature.

13. The device of claim 12, wherein the controller is configured to determine the amount of electrical energy needed to increase the determined temperature to the desired temperature using a relationship between electrical energy and a resistance of the at least one electrically conductive cord to select the amount of electrical energy.

14. The device of claim 11, wherein the controller is configured to determine the amount of electrical energy by determining a present time;

identifying an amount of electrical energy associated with the present time from a predetermined schedule including times and associated amounts of electrical energy; and using the identified amount of electrical energy as the determined amount of electrical energy.

15. The device of claim 14, wherein the predetermined schedule includes different amounts of electrical energy for different times of day and different amounts of electrical energy for different seasons.

16. The device of claim 11, wherein the controller is configured to determine the amount of electrical energy by determining an ambient temperature near at least a selected portion of the jacket; and determining the amount of electrical energy from a predetermined relationship between ambient temperature and electrical energy needed to achieve the desired jacket temperature.

17. The device of claim 11, wherein the controller is configured to monitor the temperature of the jacket; and continue the supplying if the temperature of the jacket is below the desired temperature, or pause the supplying if the temperature of the jacket exceeds the desired temperature.

18. The device of claim 11, wherein the controller is configured to monitor a temperature of the at least one electrically conductive cord; and continue the supplying if the temperature of the at least one electrically conductive cord is below a temperature corresponding to the jacket reaching the desired temperature, or pause the supplying if the temperature of the at least one electrically conductive cord exceeds the temperature corresponding to the jacket reaching the desired temperature.

19. An elevator system, comprising:

the device of claim 11;

an elevator car;

a counterweight;

the elevator tension member coupling the elevator car and the counterweight; and at least one electrical connector establishing a connection between the at least one electrically conductive cord and the controller, wherein the at least one electrically conductive cord comprises a plurality of load bearing cords, at least two of the load bearing cords are electrically coupled together, and the controller is configured to supply the electrical energy to the load bearing cords that are electrically coupled together.

20. The elevator system of claim 19, comprising at least one sheave that guides movement of the tension member and wherein the tension member comprises a flat belt, the flat belt has at least one surface configured to engage the at least one sheave, the at least one surface extends across a width of the flat belt between edges along sides of the flat belt, and the electrically coupled load bearing cords include only selected ones of the load bearing cords that are near the edges.

* * * * *